US005718136A

United States Patent [19]

Aldieri et al.

[11] Patent Number: 5,718,136

[45] Date of Patent: Feb. 17, 1998

[54] LOST KEY LOCK-OUT CYLINDER

[75] Inventors: Raymond Aldieri, Plantsville; Jerome V. Andrews, Southington; John C. Bergstrom, Burlington; Thomas J. DiVito, Southington, all of Conn.

[73] Assignee: Kaba High Security Locks Corporation, Southington, Conn.

[21] Appl. No.: 521,890

[22] Filed: Aug. 31, 1995

[51] Int. Cl.[6] ..... E05B 25/00

[52] U.S. Cl. ..... 70/385; 70/384; 70/337; 70/340; 70/395; 70/398

[58] Field of Search ..... 70/384, 385, 398, 70/395, 400, 340, 342

[56] References Cited

U.S. PATENT DOCUMENTS

| | | | |
|---|---|---|---|
| 947,913 | 2/1910 | Jenkins | 70/398 |
| 3,059,462 | 10/1962 | Check | 70/384 |
| 3,099,151 | 7/1963 | Schalge | 70/384 |
| 3,149,486 | 9/1964 | Russell et al. | 70/384 |
| 3,486,355 | 12/1969 | Halfyard | 70/398 |
| 4,031,729 | 6/1977 | Gretler | 70/380 |
| 4,412,437 | 11/1983 | Smith | 70/338 |
| 4,440,009 | 4/1984 | Smith | 70/385 |
| 4,667,494 | 5/1987 | Joosten | 70/394 |
| 4,712,401 | 12/1987 | Monahan | 70/382 |
| 4,741,188 | 5/1988 | Smith | 70/383 |
| 4,747,281 | 5/1988 | Monahan | 70/383 |
| 4,836,002 | 6/1989 | Monahan | 70/382 |
| 5,172,578 | 12/1992 | Bitzios | 70/394 |
| 5,265,455 | 11/1993 | Grimmer | 70/492 |

*Primary Examiner*—Steven N. Meyers
*Assistant Examiner*—Tuyet-Phuong Pham
*Attorney, Agent, or Firm*—Alix, Yale & Ristas, LLP

[57] ABSTRACT

A rekeyable look includes at least one chamber housing a tumbler pin stack having a master pin disposed between the driver pin and the bottom pin. The bitting of a change code key inserted in the keyway displaces the tumbler pin stack containing the master pin such that the interface between the master pin and the bottom pin is placed on the shear line defined by the cylinder shell and plug. Rotation of the change code key aligns a first slot on the change code key with the master pin wherein the master pin is received by the first slot. The master pin is carried with the change code key on removal of the key from the keyway. A replacement master pin disposed in the first slot is inserted into the keyway with the change code key. Rotation of the change code key aligns the replacement master pin with the drive pin. Inserting a control slide in a second slot in the change code key biases the replacement master pin and drive pin wherein the interface between the control slide and replacement master pin is placed on the shear line. The replacement master pin is captured in the chamber upon rotation and removal of the change code key and control slide.

6 Claims, 12 Drawing Sheets

LOST KEY LOCK-OUT CYLINDER

BACKGROUND OF THE INVENTION

1. Field of the Invention

The present invention relates to enhancing the security afforded by a mechanical lock and, particularly, to an improved technique for changing the code of a cylinder lock. More specifically, this invention is directed to a lock system which includes a novel cylinder and cooperating change code key(s) and, specifically, to such a system wherein the operating code of the cylinder may be substantially instantaneously changed by insertion and rotation of a "lock-out" key. Accordingly, the general objects of the present invention are to provide novel and improved methods and apparatus of such character.

2. Description of the Prior Art

Locks which have the capability of being "rekeyed" are well-known in the art. While not limited thereto in their utility, such locks are widely used to control access to a cache of coins, i.e., a coin box, such as found in a public telephone or a vending or gambling machine. One circumstance which will dictate the changing of the operating code of a lock, i.e., the key bitting which will allow operation of the lock, is the loss of an authorized key.

An inherent deficiency in the previously available locking systems which had code change capability resided in the fact that the rekeying required the intervention of skilled personnel. As a further disadvantage of the prior art, a code change customarily required cylinder removal and replacement and thus was relatively expensive.

SUMMARY OF THE INVENTION

The present invention overcomes the above-briefly discussed and other deficiencies and disadvantages of the prior art by providing a novel technique whereby untrained personnel may substantially instantaneously alter the code of a lock in such a manner that a missing key is forever blocked from operating the lock. The invention also encompasses a new cylinder and cooperating change code keys for implementation of this novel code changing technique.

A cylinder in accordance with the present invention is characterized by at least one pin tumbler stack which includes, in addition to the usual bottom and driver pins, a third or master pin. The master pin is located between the other two pins. The interface between the master and one of the other pins, typically the driver pin, lies on the shear line of the cylinder with a properly bitted key in the keyway. A novel change code key is provided with bitting commensurate with an operating code of the cylinder on a first surface and, on an oppositely disposed second surface, with a cut-out having a depth which equals the length of the master pin. The change code key may be used to extract the master pin from the cylinder to thereby change the code.

Also in accordance with the invention, a change code key may be employed to insert a master pin in a pin stack. For this purpose, the change code key has, in addition to the master pin receiving cut-out, a longitudinal slot for receiving a control slide. The control slide receiving slot intersects the cut-out and enables a master pin to be inserted against the bias of the driver spring, the inserted master pin being displaced so as to place its radially inwardly disposed end at the shear line after alignment is established between the master pin and the pin tumbler receiving chamber in the shell of the lock. Rotation of the change code key and control slide after lifting of the master pin will establish a new pin stack which includes the master pin tumbler.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 2:
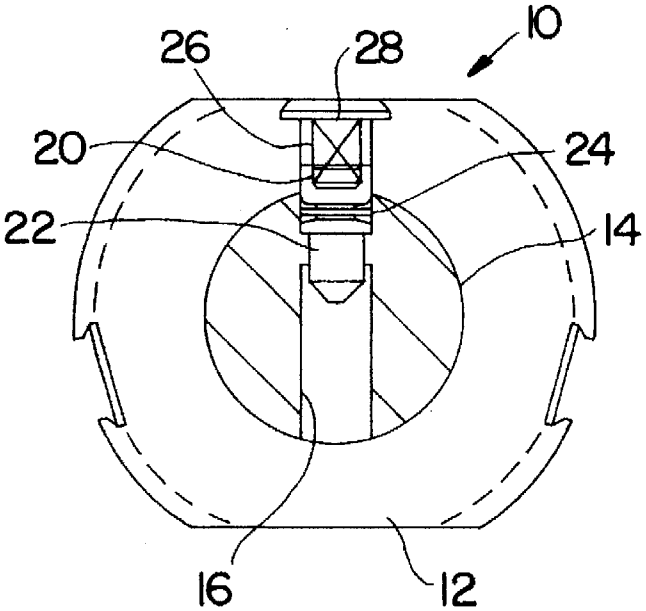
FIG. 2 is a schematic, cross-sectional view of the cylinder of FIG. 1, FIG. 2 being taken transversely with respect to FIG. 1 along line 2—2 of FIG. 1 looking into the pin chamber shown in FIG. 1.

With reference to the drawings, a cylinder is indicated generally at 10. As is conventional, cylinder 10 includes a shell 12 and a plug 14. Plug 14 is rotatable, relative to shell 12, about its axis and defines a keyway 16. Keyway 16 will, of course, have a profile, i.e., a cross-section, which is unique to cylinder 10. The shell 12 and plug 14 are provided with pin chambers, i.e., cavities which house the tumbler pins of the cylinder. In the disclosed embodiment, the cylinder 10 is of the type which has a single linear array of pin tumbler stacks and the pin chambers provided in shell 12 and plug 14 are in axial alignment when the cylinder is in the locked condition depicted in FIGS. 1 and 2. The pin chambers in plug 14 extend from the keyway 16 to the outer circumference of the plug.

In the interest of facilitating understanding of the invention, only a single pin tumbler stack of the array of such stacks provided in cylinder 10 has been shown in the drawings. This single array comprises a top or driver pin 20, a bottom pin 22 and, located intermediate the driver and bottom pins, a "master" pin 24. The pins will customarily have a generally circular cross-section. The end of driver pin 20 which faces radially outwardly with respect to the axis of rotation of plug 12 is provided with a recess which receives the first end of a driver spring 26. The opposite end of spring 26 acts against a spring cover 28 which is affixed to shell 12. Accordingly, the pin stacks are biased in the direction of the axis of rotation of plug 14.

Figure 1:
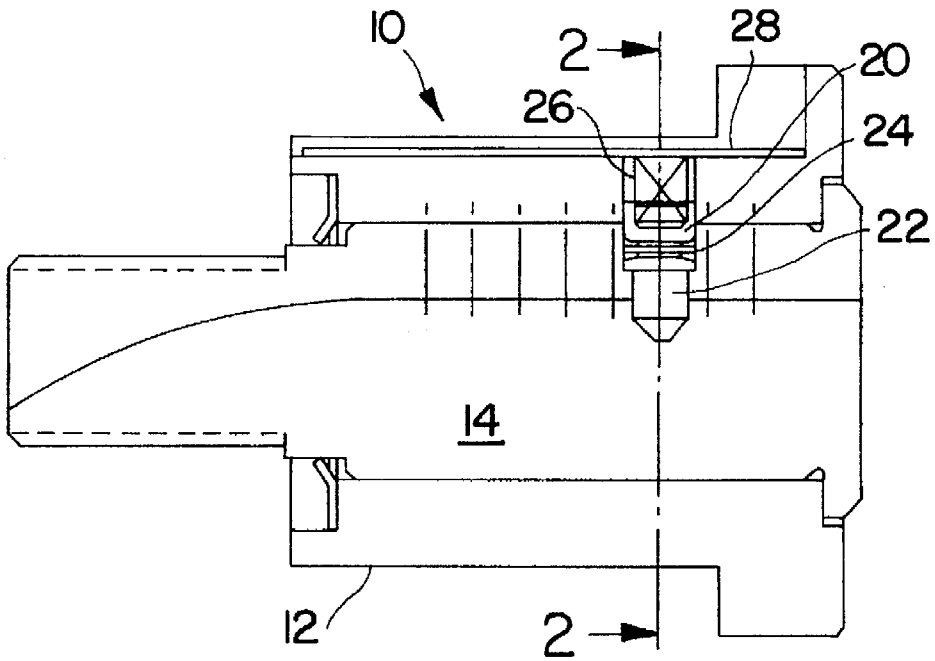
FIG. 1 is a schematic, side elevation view of a cylinder in accordance with the invention, FIG. 1 depicting only one of an array of pin chambers with its cooperating pin tumbler stack.

The interface between the inner diameter of shell 12 and the outer diameter of plug 14 defines a shear line. If any of the pins of any of the stacks of the array in cylinder 10 intersects the shear line, relative rotation between the plug and shell is prevented. In the embodiment depicted, with the cylinder in the locked position, the top or driver pins 20 will extend across the shear line as shown in FIGS. 1 and 2.

The operating code for cylinder 10 is determined by selection of the lengths of the pins comprising each pin stack. In order to operate the cylinder from the locked to the unlocked state, i.e., in order to enable the rotation of plug 14 relative to shell 12, a properly bitted key must be inserted in keyway 16. A properly bitted key will raise the bottom pins 22 of all of the pin stacks to the point where an interface between two of the pins of each stack will lie on the shear line. In a typical case, the bitting or coding of the key will take the form of "cuts" in an edge portion of the key blade. Rotation of plug 14 subsequent to insertion of a properly coded key in keyway 16 will impart movement to a tail piece, not shown, connected to the plug and the subsequent retraction of a blocking mechanism, i.e., a bolt or the like, which is operated by the tail piece.

Figure 5:
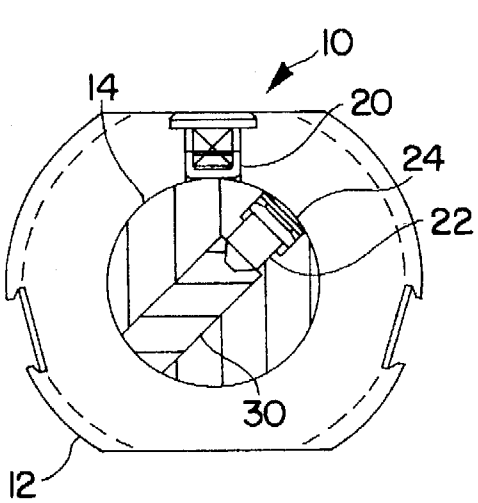
FIG. 5 is a view similar to FIG. 4 with the cylinder plug rotated.
Figure 4:
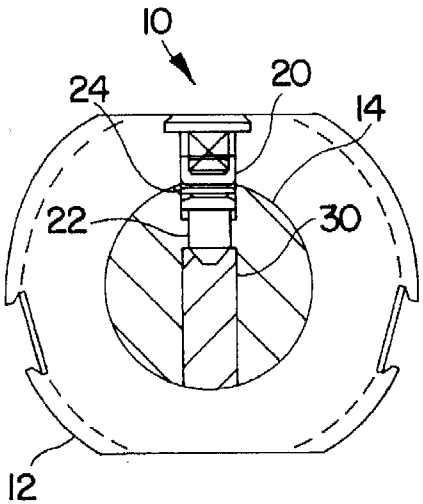
FIG. 4 is a view similar to FIG. 2 with the key of FIG. 3 inserted in the keyway.
Figure 3:
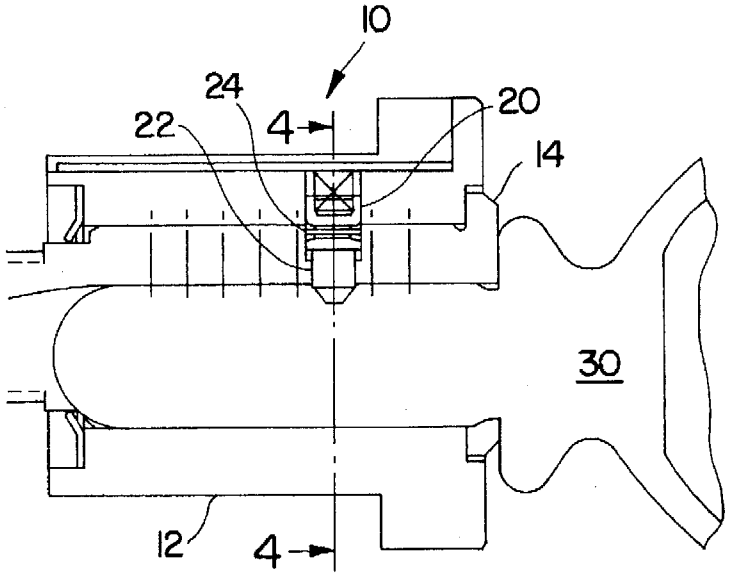
FIG. 3 is a view similar to FIG. 1 depicting the cylinder with a properly coded operating key inserted into the keyway defined by the plug of the cylinder.

FIGS. 3–5 depict the operation of cylinder 10 by means of insertion of a properly coded operating key 30 in keyway 16. The upper edge of the blade of key 30, as the key is depicted in the drawings, is cut to define recesses which receive the cooperating frusto-conically shaped lower ends of the bottom pins 22. When the cuts in the key blade are of the proper depth, the shear line will fall exactly between the top or driver pin 20 and the master pin 24 in the embodiment shown. Accordingly, the plug 14 may be rotated relative to shell 12 from the key insertion or locked position of FIG. 4 and, as may be seen from FIG. 5, during such rotation the bottom and master pins will travel with the plug while the inwardly disposed end of driver pin 20 "rides" on the outer circumference of the plug.

Figure 8:
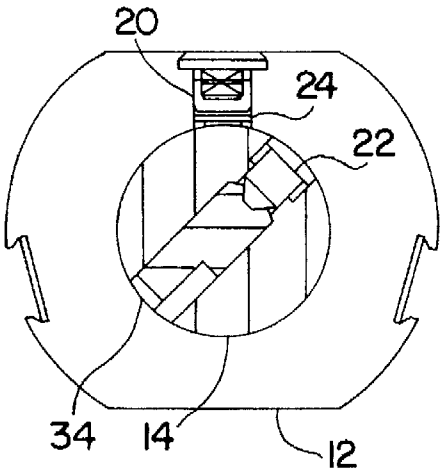
FIG. 8 is a view similar to FIG. 5 showing the change code key rotated.
Figure 7:
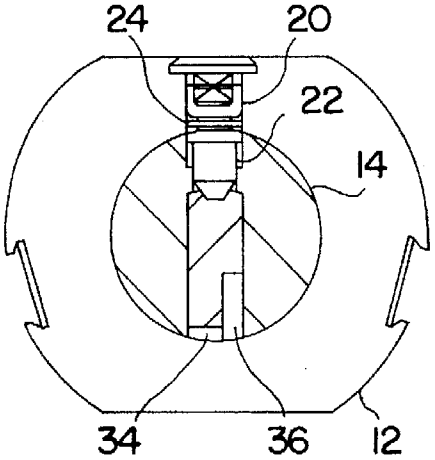
FIG. 7 is a view similar to FIGS. 2 and 4 with the change code key inserted in the keyway.
Figure 6:
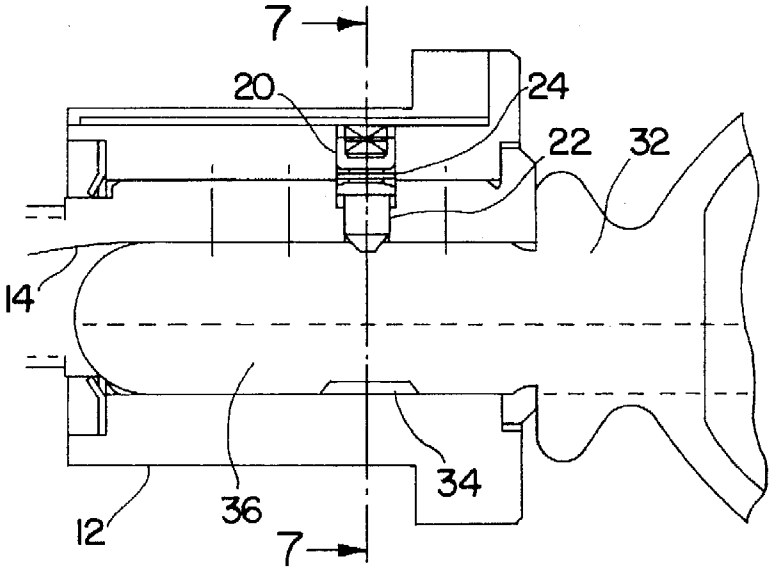
FIG. 6 is a view similar to FIGS. 1 and 3 depicting a properly coded change code key inserted in the keyway.

In accordance with the present invention, at least one of the pin stacks will include the third or master pin 24. In the least complicated implementation of the invention, the master pin 24 will be included in only a single pin stack and the remaining pin stacks will, as is conventional practice, include only a top or driver pin and a bottom pin. Should it become necessary to "lock out" key 30, for example because a copy of proper operating key 30 has been lost, a change code key 32 will be inserted in keyway 16 as depicted in FIG. 6–14. The change code key 32 will, on the top edge of its blade, be provided with bitting which will operate cylinder 10. This bitting, in the case of the pin stack which includes master pin 24, will be different than that of key 30 in that the interface between the master pin 24 and bottom pin 22 will be placed at the shear line. Additionally, change code key 32 will be provided, on the opposite edge of the blade, with a slot 34 which is in alignment with a pin tumbler stack which includes a master pin 24. The depth of the slot 34 will be commensurate with the length of the master pin 24 with which it is in registration. The change code key 32 will also be provided, extending longitudinally along its length, with a control slide slot 36 which extends through the key bow. Insertion of change code key 32 into keyway 16 permits rotation of plug 14 relative to shell 12 in the normal manner as depicted in FIGS. 7 and 8. The master pin 24 will remain in the pin chamber in shell 12 during the initial portion of such rotation as shown in FIG. 8.

Figure 11:
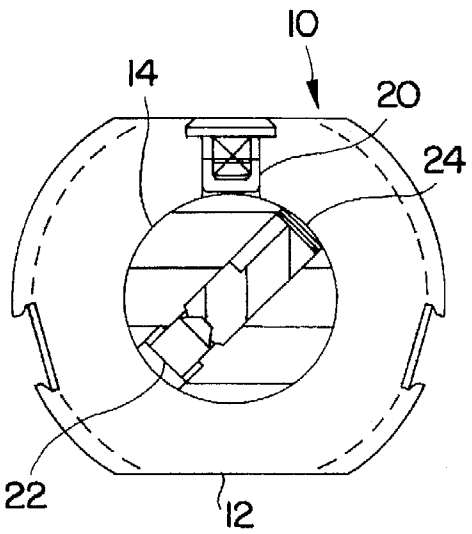
FIG. 11 is a view similar to FIG. 10 with the rotation of the change code key continued beyond 180°.
Figure 10:
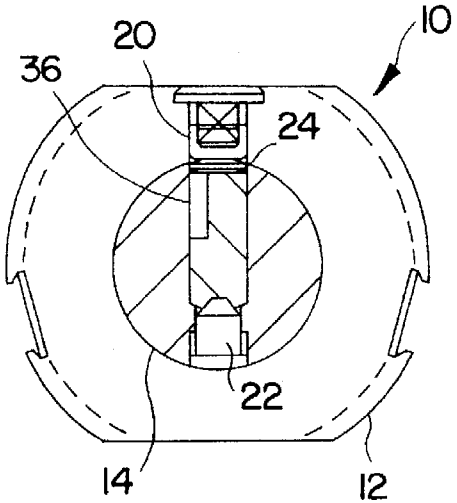
FIG. 10 is a cross-sectional schematic view taken transversely with respect to FIG. 9.
Figure 9:
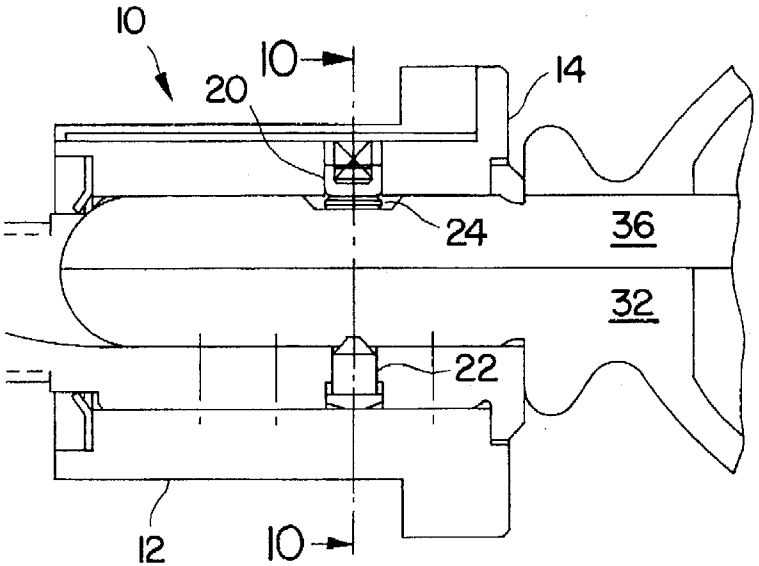
FIG. 9 is a view similar to FIG. 6 showing the condition of the cylinder with the plug rotated 180°.
Figure 13:
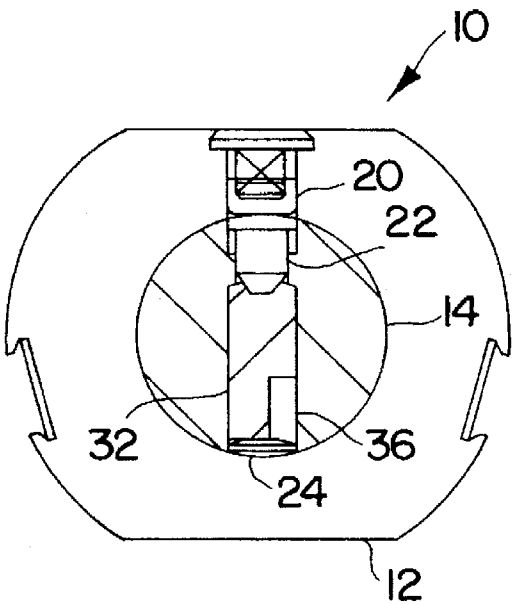
FIG. 13 is a cross-sectional view taken in transverse to FIG. 12.
Figure 12:
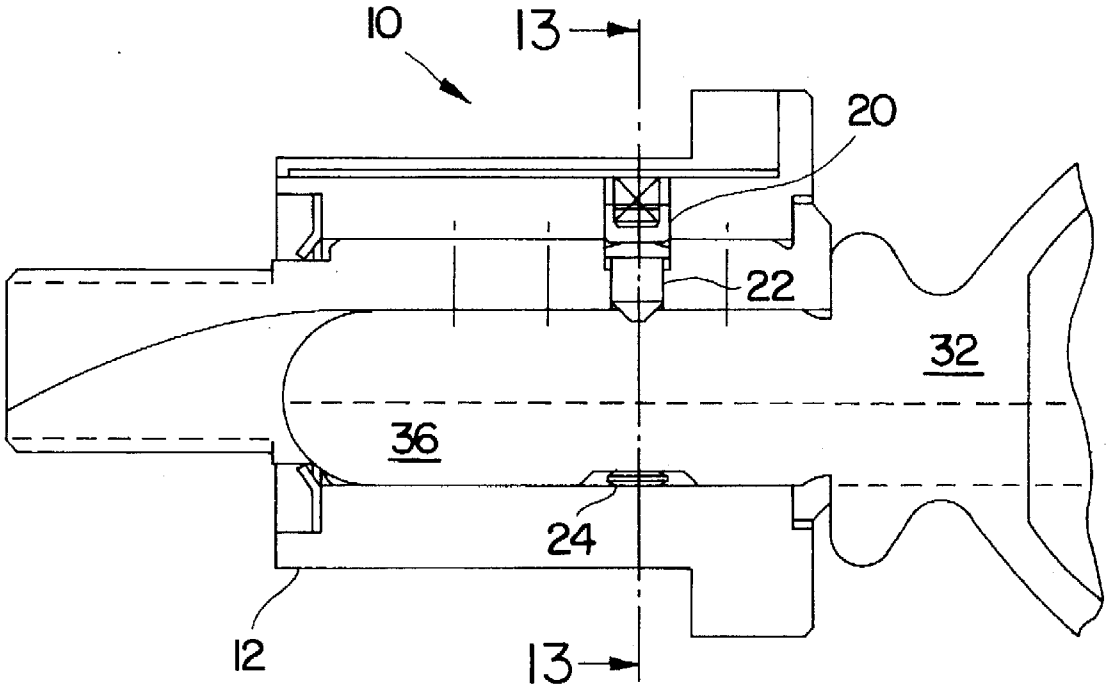
FIG. 12 is a view similar to FIGS. 6 and 9, FIG. 12 depicting the condition of the cylinder when the plug has been rotated through a complete revolution with the change code key in the keyway.
Figure 14:
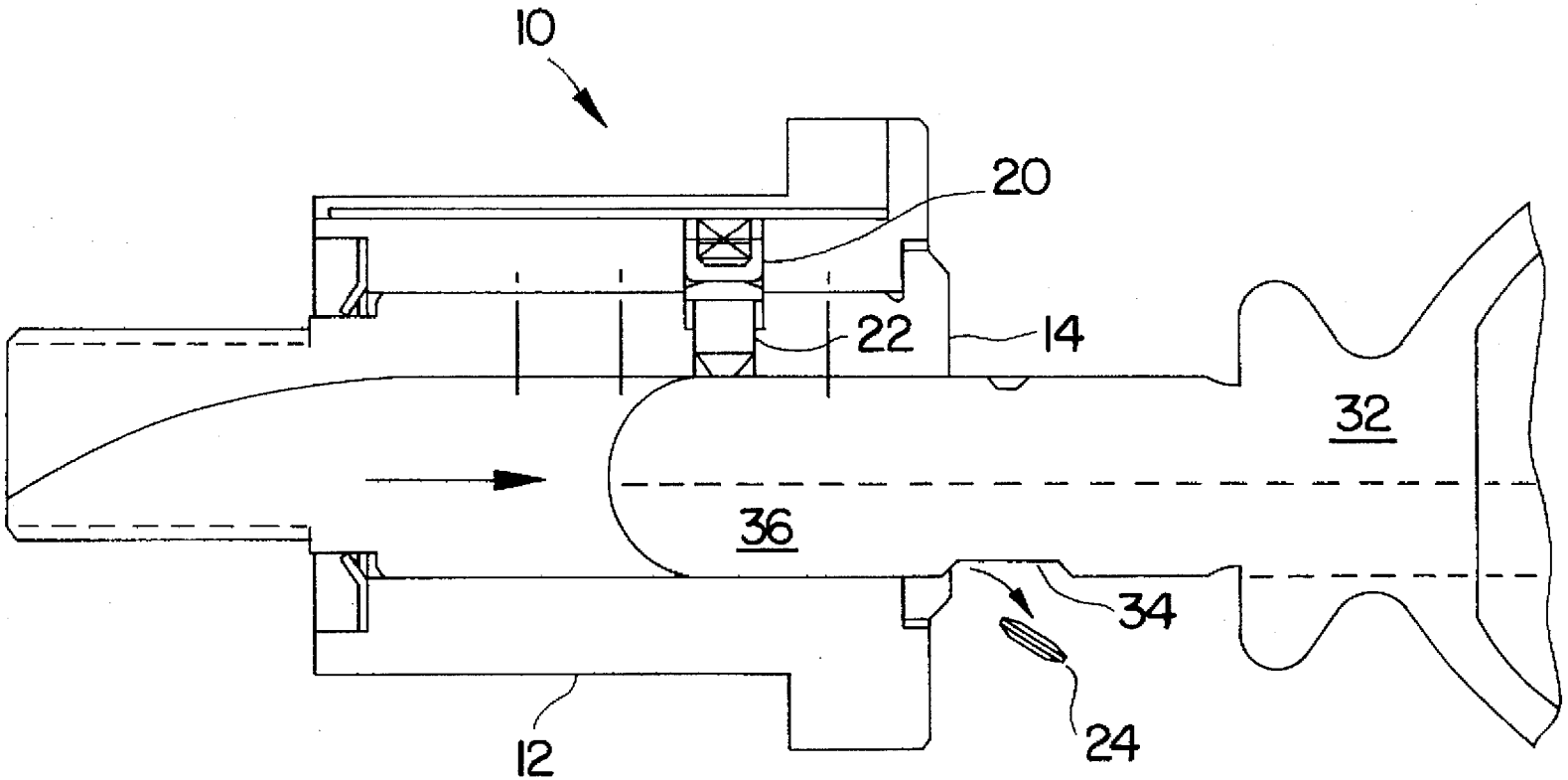
FIG. 14 is a schematic, side elevation view similar to FIG. 12 which depicts removal of the change code key.

As may be seen from FIG. 9, when the change code key 32 has been rotated 180°, the slot 34 will be in registration with the pin stack and, under the influence of driver spring 26, the master pin 24 will be moved into slot 34. As may be seen from FIGS. 9 and 10, this will place the interface between master pin 24 and driver pin 20 at the shear line. Accordingly, continued rotation of the change code key 32, as depicted in FIG. 11, will cause the master pin 24 to travel with plug 14. At the end of a complete rotation of change code key 32, the master pin 24 will be in the position depicted in FIGS. 12 and 13, i.e., the master pin 24 will be separated from the pin stack, will be resting on the inner diameter of shell 12 and will be trapped in slot 34. Also, the bottom pin 22 will be in contact with driver pin 20, i.e., a new pin tumbler stack having two pins will have been formed. The change code key 32 may now be withdrawn from keyway 16, as shown in FIG. 14, thus expelling the master pin 24 from cylinder 10. At this point, the operating key 30, if found by an unauthorized party, will be "locked out", i.e., the bitting on the key blade will no longer match the coding of the cylinder because of the reconfiguration of the pin stack which previously included the master pin 24.

The code of cylinder 10 may be further changed by insertion of a new master pin 40, i.e., a master pin having a different length when compared to master pin 24, in the pin stack from which master pin 24 has been removed. Such insertion of a new master pin 40 is depicted in FIGS. 15–20. The insertion of a new master pin 40 requires the use of a new change code key 42 which, like change code key 32, includes a master pin receiving slot 44 in the "lower" edge of the key blade and also a longitudinal control slide slot 46. The bitting, i.e., the cuts, provided in the "upper" edge of the blade of new change code key 42 will be commensurate with the "new" cylinder coding. In the example being described, the "new" coding will be the coding resulting from removal of the original master pin 24.

Figure 15:
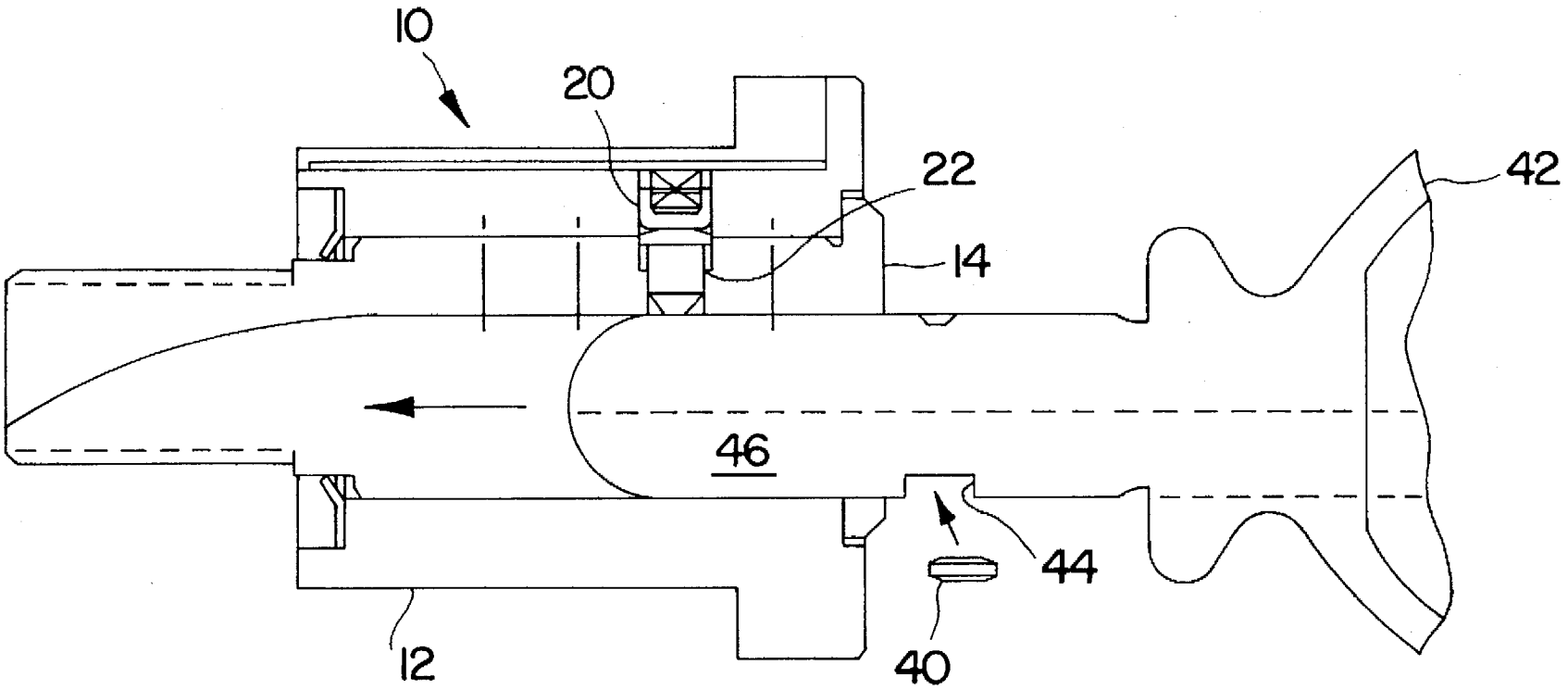
FIG. 15 depicts the first step of an optional further procedure which may be employed in changing the code of a cylinder in accordance with the present invention.
Figure 17:
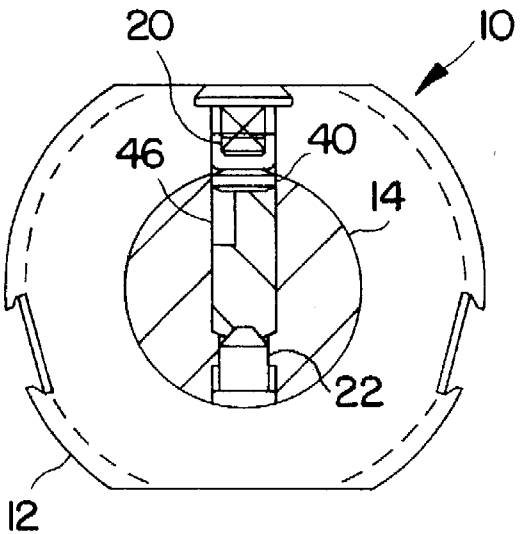
FIG. 17 is a schematic cross-sectional view taken along line 17—17 of FIG. 16.
Figure 16:
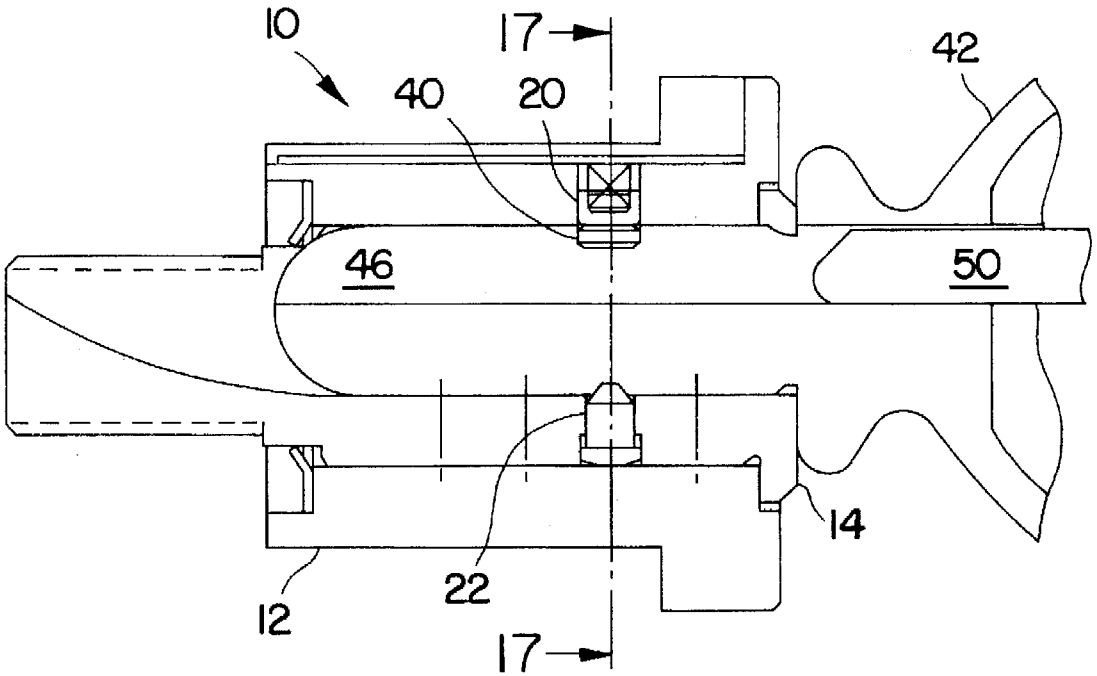
FIG. 16 is a view similar to FIG. 15 but showing a further step wherein a new master pin is inserted into the pin stack.
Figure 20:
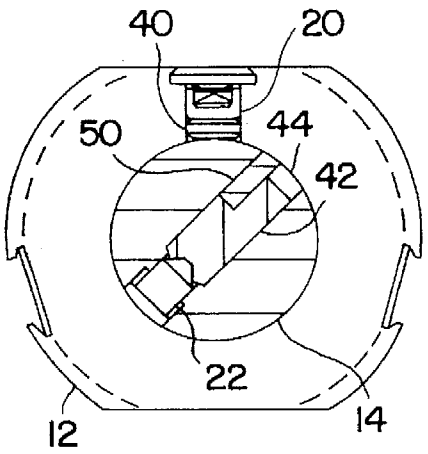
FIG. 20 is a view similar to FIG. 19 but showing the combination of the change code key and control slide rotated from the position of FIG. 19.
Figure 19:
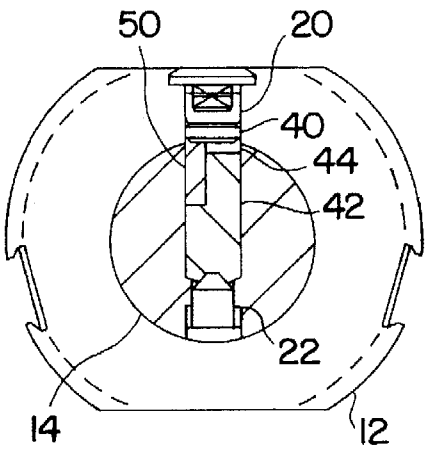
FIG. 19 is a view taken along line 19—19 of FIG. 18.
Figure 18:
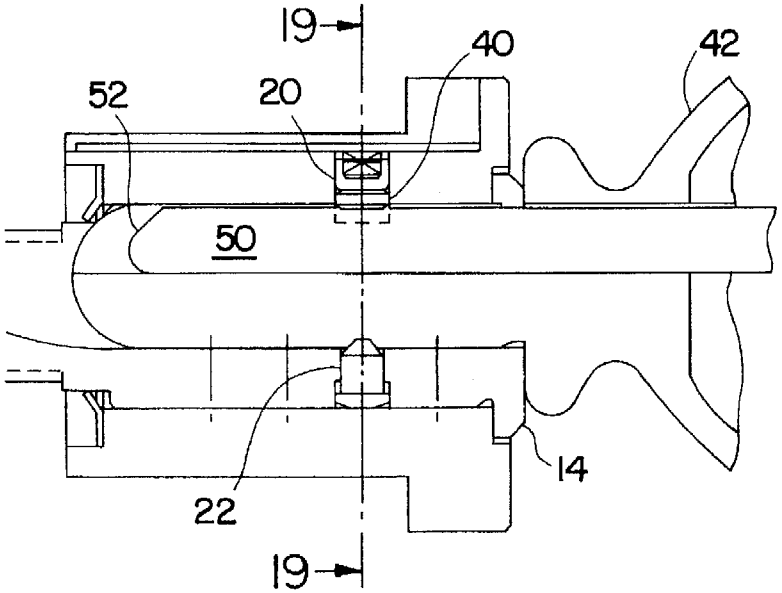
FIG. 18 is a view similar to FIG. 16 and depicting the insertion of a control slide into the keyway.

As may be seen from FIG. 15, the insertion of the new master pin 40 is accomplished by placing the new master pin in the slot 44 in the blade of key 42, fully inserting the key and then rotating the new change code key 180° to the position shown in FIGS. 16 and 17. This will place new master pin 40 in axial alignment with driver pin 20. With the new change code key 42 in the position shown in FIGS. 16 and 17, a control slide 50 is inserted into the control slide slot 46 the slide being guided during insertion by the shoulder at the bottom of slot 46 as the change code key is depicted in FIGS. 16 and 17. As may be seen from FIG. 18, the control slide 50 is provided with a contoured leading edge 52. This contoured edge cams the new master pin 40 upwardly against the bias of driver spring 26 as slide 50 is inserted. This upward movement of new master pin 40 will place the interface between the edge of control slide 50 and the radially inward facing end of new master pin 40 at the shear line (see FIGS. 18 and 19). Accordingly, the plug may be rotated with the compound key comprising the control slide 50 and new change code key 42, as shown in FIG. 20, leaving new master pin 40 in the pin chamber provided in shell 12, i.e., a new pin tumbler stack comprising driver pin 20, bottom pin 22 and new master pin 40 will have been established. This new pin stack will establish a new code for cylinder 10, i.e., because the axial length of the new master pin 40 will be different from that of the removed master pin 24, a new proper operating key will have a cut, i.e., a bit, which is different from that of the original operating key 30.

Figure 23:
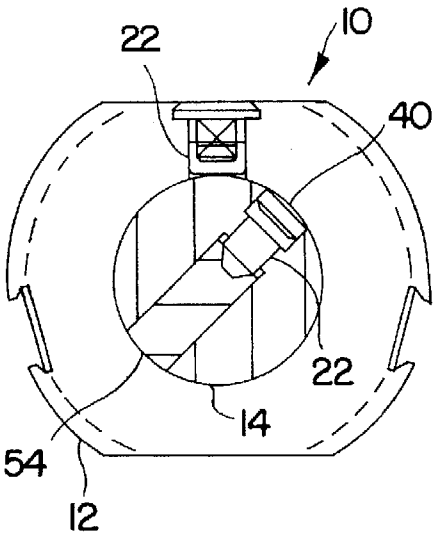
FIG. 23 is a view similar to FIG. 22 but showing the plug and new operating key rotated from the position of FIG. 22.
Figure 22:
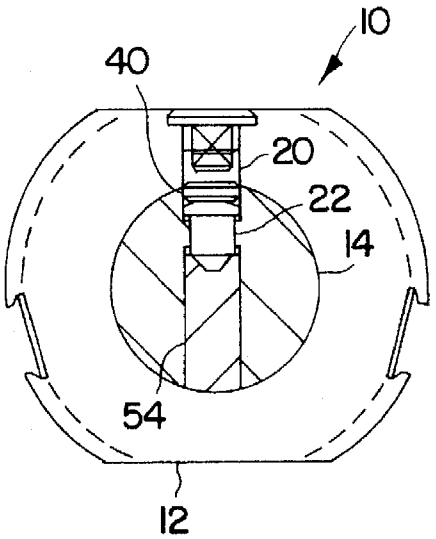
FIG. 22 is a view taken along line 22—22 of FIG. 21.
Figure 21:
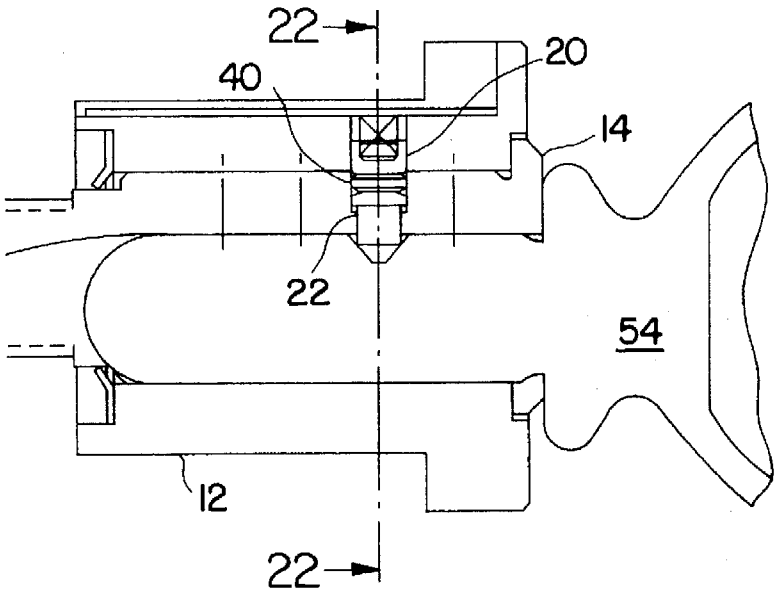
FIG. 21 is a view similar to FIG. 1 and showing a new operating key inserted in the keyway.

A new operating key, i.e., a key which is cut commensurate with the new code established by the insertion of new master pin 40 in the pin stack, is indicated at 54 in FIGS. 21–23. FIGS. 21–23 thus correspond to FIGS. 3–5 and show the operation of cylinder 10 with the new operating key 54.

Figure 25:
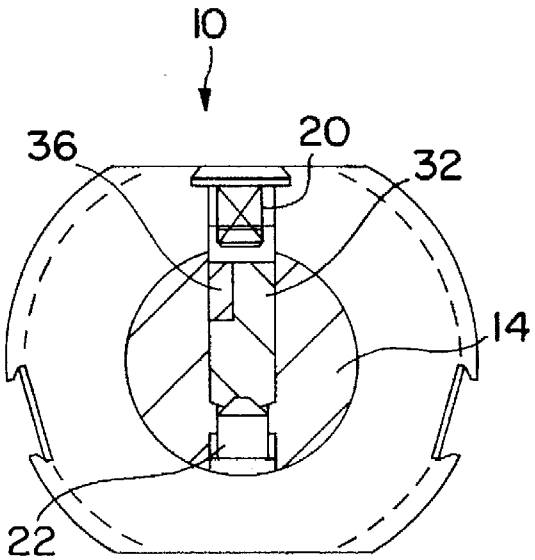
FIG. 25 is a cross-sectional schematic view taken transversely with respect to FIG. 24.
Figure 24:
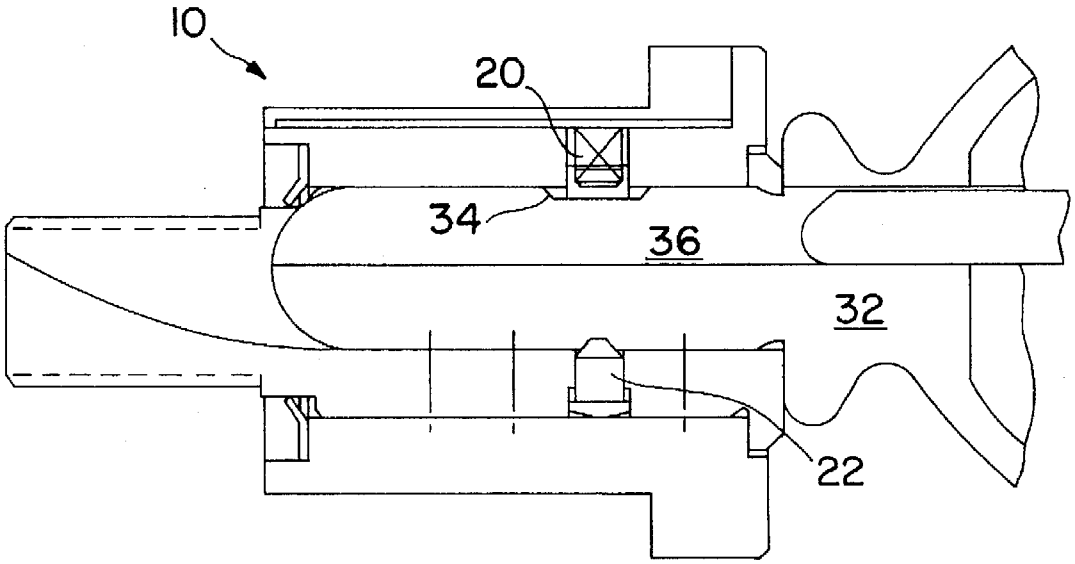
FIG. 24 is a view similar to FIG. 12, FIG. 24 depicting the condition of a cylinder from which the master pin has been removed when the change code key has been inserted in the keyway of a cylinder and rotated 180°.
Figure 28:
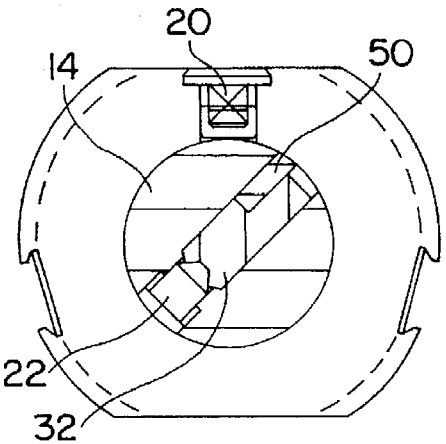
FIG. 28 is a view similar to FIG. 27 with the rotation of the change code key continued beyond 180°.
Figure 27:
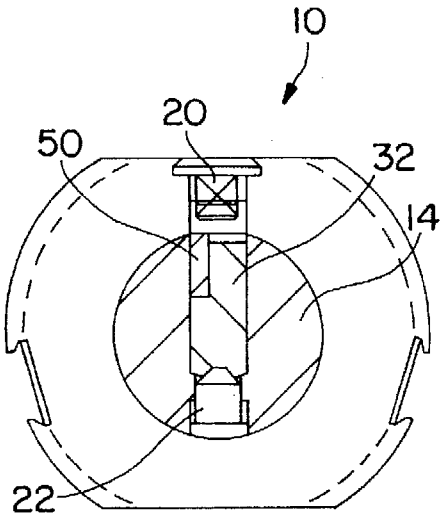
FIG. 27 is a cross-sectional schematic view taken transversely with respect to FIG. 26.
Figure 26:
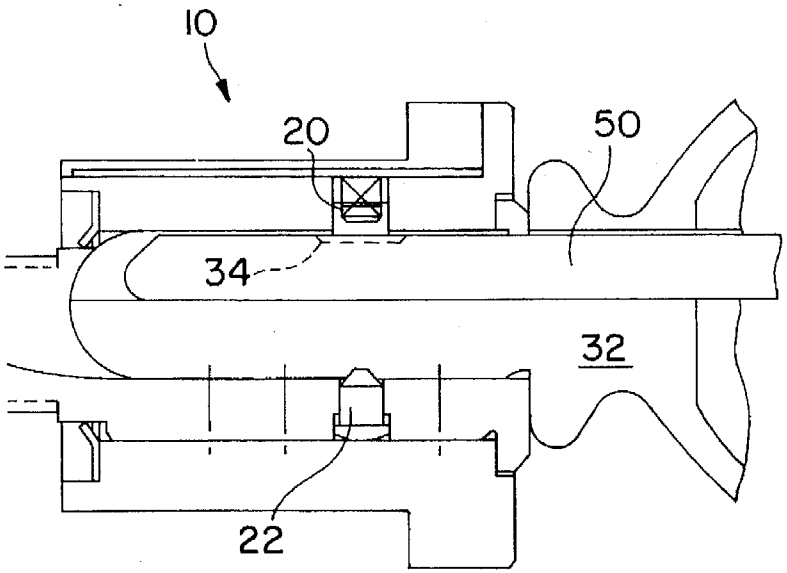
FIG. 26 is a view similar to FIG. 24 and depicting the insertion of a control slide into the keyway.

It should be further appreciated that the control slide slot 36, 46 and control slide 50 provide a means for removing a change code key 32, 42 which is frozen in the cylinder 10. As shown in FIG. 9, the master pin 24 is biased into the master pin receiving slot 34 when a change code key 32 is inserted into the keyway 16 and rotated 180°. If the master pin 24 has been previously removed, the lower end of the driver pin 20 will be biased into the master pin receiving slot 34 (FIGS. 24 and 25). When so positioned, the driver pin 20 intersects the shear line, preventing relative rotation between the plug and the shell and freezing the change code key 32 in the cylinder 10. As shown in FIGS. 26 and 27, inserting a control slide 50 into the control slide slot 36 biases the driver pin 20 out of the master pin receiving slot 34, placing the end of the master pin at the shear line. Accordingly, the plug may be rotated with the compound key as shown in FIG. 28.

As will be obvious to those skilled in the art, and as noted above, the lock out of the original proper operating key 30 may be accomplished simply by inserting a change code key, turning the change code key through a complete rotation and then withdrawing the change code key and a master pin. If the master pin is removed from a side biting, it would be possible to change the code by turning the key 90 degrees. This lock-out operation may be performed without employing the services of a highly trained locksmith. Obviously, as also noted above, one or a plurality of the pin stacks in the cylinder may be provided with a master pin 24. To select the specific master pin 24 which will be removed, the control slide 50 is inserted in the control slide slot 36 prior to rotating the plug. Once the master pin receiving slot 34 is aligned with the selected master pin 24, the control slide is removed and the master pin 24 is biased into the slot 34. The present invention also permits the insertion of a master pin in a stack from which a previous master pin has been extracted or into a stack which did not previously have three tumbler pins. Such insertion, like a master pin extraction, does not require the intervention of a skilled technician.

While a preferred embodiment has been shown and described, various modifications and substitutions may be made thereto without imparting from the spirit and scope of the invention. Accordingly, it is to be understood that the present invention has been described by way of illustration and not limitation.

What is claimed is:

1. A changeable code cylinder lock system comprising:

a shell, said shell having a longitudinal axis and an inner diameter, said shell further having at least one pin tumbler stack receiving chamber which communicates with said inner diameter, said chamber having an axis which is generally radially oriented with respect to said axis;

a plug rotatably disposed in said shell, said plug having an outer diameter and having a longitudinally extending keyway formed therein, a shear line being defined between said shell inner diameter and said plug outer diameter, said keyway extending to said shear line in at least two angularly displaced regions;

a pin tumbler stack reciprocally disposed in said receiving chamber of said shell, said pin tumbler stack comprising at least a bottom pin, a driver pin and a first master pin, said pins being axially aligned and having preselected axial lengths, said first master pin being disposed intermediate said bottom pin and said driver pin, said pin tumbler stack further including resilient biasing means in contact with said driver pin for urging said axially aligned pins to a position where one of said pins extends across said shear line when a key having a properly bitted blade is not present in said keyway, insertion of a properly bitted key into said keyway causing displacement of said axially aligned pins under the influence of said biasing means whereby the interface between an adjacent pair of said pins is located on said shear line and rotation of said plug relative to said shell is permitted;

a first change code key, said first change code key having a bow and an elongated blade which extends longitudinally from said bow, said blade having a cross-section which permits insertion thereof into said keyway, said blade being provided with irregularities in a first surface thereof, said first surface being located in one of said angularly displaced keyway regions when said first change code key is in said keyway, said irregularities being commensurate with a bitting which will place the interface between said bottom and first master pins at said shear line and which will permit rotation of said plug relative to said shell, said change code key blade further having at least a first open-sided cut-out in a second surface thereof, said second surface being located in the other of said angularly displaced keyway regions when said first change code key is in said keyway, said cut-out having a depth commensurate with the axial length of said first master pin;

rotation of said plug by means of said first change code key aligning said first cut-out with said pin tumbler stack receiving chamber whereby said biasing means will cause said first master pin to move into said first cut-out in said first change code key and the interface between said driver and first master pins will be positioned on the shear line, said first master pin being removable from said plug by subsequent withdrawal of said first change code key from said keyway;

at least a second change code key, said second change code key having a bow and a blade which extends longitudinally from said bow, said blade of said second change code key having a cross-section which permits insertion thereof into said keyway, said blade of said second change code key being provided with irregularities in a first surface thereof, said first surface of said second change code key being located in said one angularly displaced keyway regions when said second change code key is in said keyway, said irregularities in said second change code key first surface being commensurate with a bitting which will permit rotation of said plug relative to said shell, said second change code key further having at least a first open-sided cut-out in a second surface thereof and a longitudinally extending open-sided slot, said second surface of said second change code key being located in said other of said angularly displaced keyway regions when said second change code key is inserted in said keyway, said slot intersecting and being in fixed relation to said cut-out, the depth of said first cut-out of said second change code key being different than the depth of the first cut-out in said first change code key and being commensurate with the length of a second master pin, a first end of said slot being accessible when said second change code key is inserted in said keyway a control slide, said control slide having a cross-section which permits reception thereof in said longitudinal slot of said second change code key after insertion of said blade of said second change code key in said keyway, said control slide having sufficient length to be at least in part in registration with said first cut-out in said blade of said second change code key when said slide is received in said slot whereby said control slide may be employed to selectively reduce the depth of said first cut-out in said blade of said second change code key;

substitution of a second master pin for said first master pin being accomplished by inserting said second change code into said keyway with said second master pin disposed in said first cut-out in said blade of said second change code key, establishing alignment between said second master pin and said pin stack receiving chamber of said shell by rotating said plug with said second change code key, imparting a radially outwardly directed force to said second master pin by inserting said control slide into said longitudinal slot of said second change code key to thereby displace said second master pin against said biasing means so as to place the interface between said second master pin and said control slide on said shear line, and thereafter rotating said plug and withdrawing said control slide and said second change code key from said keyway.

2. The lock system of claim 1 wherein the surface irregularities which define the key bitting and the open-sided cut-outs are formed in oppositely disposed edges of said change code keys, said oppositely disposed edges being interconnected by a pair of oppositely disposed side faces, and wherein said longitudinal slot of said second change code key is formed in one of said side faces thereof.

3. The lock system of claim 2 wherein said control slide includes a camming surface on a first end thereof, said camming surface cooperating with said second master pin whereby longitudinal motion of said control slide in said slot imparts motion in a generally transverse direction to said second master pin.

4. A method for rekeying a cylinder lock having a shell with at least one pin tumbler receiving chamber and a plug mounted in the shell for rotation about an axis, the plug having a longitudinally extending keyway formed therein, a shear line being defined between the shell and the plug, the keyway communicating with the shear line so as to be registerable with the pin tumbler receiving chamber, a pin tumbler reciprocally mounted in said one receiving chamber of the shell, the pin tumbler comprising at least a bottom pin, a driver pin and a first master pin, the first master pin being located intermediate and in contact with the bottom and driver pins, the pins having a length in the direction of reciprocal motion thereof, the lock also having a spring for biasing the pin tumbler generally in the direction of the axis of rotation of the plug to a position where one of the pins extends across the shear line when a properly bitted key is not present in the keyway, said method comprising the steps of:

inserting the blade of a first change-code key into the keyway, the blade having first and second surfaces, the first surface of the first change code key being provided with surface irregularities which define the key bitting, the second surface of the first change code key having an open-sided cut-out with a depth substantially equal to the length of the first master pin, the bitting of the first change code key displacing the pin tumbler against the urging of the spring whereby the interface between the bottom pin and the first master pin is located on the shear line;

rotating the plug with first change code key from an initial key insertion position where the first change code key is inserted in the plug to a second position where the cut-out in the second surface of the first change code key blade is aligned with the pin tumbler receiving chamber in the shell, the bottom pin rotating with the plug, said establishment of alignment between the cut-out and the chamber thus resulting in displacement of the first master pin into the cut-out under the influence of the spring, such displacement placing the interface between the driver pin and the first master pin on the shear line;

rotating the plug and first change code key to return the plug to the initial position;

simultaneously withdrawing the first change code key and the first master pin from the plug;

placing a second master pin in an open-sided cut-out in a second surface of the blade of a second change code key, the length of the second master pin being different than the length of the first master pin, the cut-out of the second change code key blade having a depth substantially equal to the length of the second master pin, the second change code key having a longitudinal slot which is parallel to the axis of plug rotation and which intersects the cut-out, the second change code key having a first surface provided with surface irregularities which define the key bitting, the bitting of the second change code key displacing the pin tumbler against the urging of the spring to position the interface between the driver pin and the bottom pin on the shear line;

inserting the second change code key with the second master pin in the keyway with the plug in the initial position;

rotating the plug with the second change code key from the initial position until the first cut-out in the blade of the second change code key is aligned with the pin tumbler receiving chamber, such alignment establishing an interface between the second master pin and the driver pin;

inserting a control slide into the longitudinal slot in the second change code key until a first end of the slide contacts the second master pin;

applying a longitudinally directed force to the control slide after contact between the first end thereof and the second master pin has been established, said longitudinal force being translated into radial motion of the second master pin against the bias of the spring, the radial pin motion placing the interface between the control slide and the second master pin at the shear line;

rotating the plug and second change code key with the inserted control slide to the initial position to establish an interface between the bottom pin and the second master pin at the shear line; and withdrawing the control slide and second change code key from the keyway.

5. A method for rekeying a cylinder lock having a shell with at least one pin tumbler receiving chamber and a plug mounted in the shell for rotation about an axis, the plug having a longitudinally extending keyway formed therein, a shear line being defined between the shell and the plug, the keyway communicating with the shear line so as to be registrable with the pin tumbler receiving chamber, a pin tumbler reciprocally mounted in the said one receiving chamber of the shell, the pin tumbler comprising at least a bottom pin and a driver pin, the pins having a length in the direction of reciprocal motion thereof, the lock also having a spring for biasing the pin tumbler generally in the direction of the axis of rotation of the plug to a position where one of the pins extends across the shear line when a properly bitted key is not present in the keyway, said method comprising the steps of:

placing a master pin in a first open-sided cut-out in a first surface of the linearly elongated blade of a change-code key, the blade of the change code key also having a second surface characterized by a pattern of surface irregularities which define the key bitting, the depth of the cut-out being substantially equal to the length of the master pin, the cut-out constraining movement of the master pin to a direction generally transverse to the length dimension of the blade, the blade of the change code key further having a longitudinal slot which intersects the first surface of the blade, the longitudinal slot also extending along the length of the blade to intersect the cut-out, the bitting on the second surface of the blade of the change code key having a contour which will cause displacement of the pin tumbler against the urging of the spring whereby the interface between the bottom pin and the driver pin is located on the shear line;

inserting the change code key with the master pin carried thereby into the keyway, the master pin being rotationally displaced from the pin tumbler receiving chamber at the initial insertion position of the change code key into the keyway;

rotating the plug by means of the inserted change code key from the initial position to a second position where the cut-out in the blade of the change code key is aligned with the pin tumbler receiving chamber, the rotation establishing an interface between the master pin and the driver pin at the shear line;

causing a control slide to enter the longitudinal slot in the change code key and to move linearly along the slot until contract between a first end of the slide and the master pin is established;

applying a longitudinally directed force to the control slide, the longitudinally directed force causing the master pin to generate a radial force which is directed generally transversely to the applied longitudinal force, the radial force being sufficient to overcome the force of the spring and displace the master pin out of the cut-out of the change code key blade whereby the interface between the master pin and the control slide will be located on the shear line;

rotating the plug with the change code key and control slide as a unit to the initial position of the plug; and withdrawing the change code key and control slide from the plug.

6. A changeable code cylinder lock system comprising:

a shell, said shell having a longitudinal axis and an inner diameter, said shell further having at least one pin tumbler stack receiving chamber which communicates with said inner diameter;

a plug rotatably disposed in said shell, said plug having an outer diameter and having a longitudinally extending keyway formed therein, a shear line being defined between said shell inner diameter and said plug outer diameter, said keyway extending to said shear line;

a pin tumbler stack reciprocally mounted in said receiving chamber of said shell, said pin tumbler stack comprising at least a bottom pin and a driver pin, said pins being axially aligned and having preselected axial lengths in the direction of motion thereof, said pin tumbler stack further including resilient biasing means in contact with said driver pin for urging said axially aligned pins to a position where one of said pins extends across said shear line when a key having a properly bitted blade is not present in said keyway, insertion of a properly bitted key into said keyway causing displacement of said axially aligned pins against the urging of said biasing means whereby the interface between an adjacent pair of said pins is located on said shear line and rotation of said plug relative to said shell is permitted;

a master pin, said master pin having a cross-section commensurate with that of said driver and bottom pins, said master pin having a preselected axial length;

a change code key, said change code key having a bow and blade which extends longitudinally from said bow, said blade having a cross-section which permits insertion thereof into said keyway, said blade being provided with irregularities in a first surface thereof commensurate with a bitting which will place the interface between an adjacent pair of said pins at said shear line, said change code key blade further having at least a first open-sided cut-out in a second surface thereof and a longitudinally extending open-sided slot, said slot intersecting and being in fixed relation to said cut-out, said cut-out having a depth commensurate with the length of said first master pin, said slot extending from said blade second surface for a distance which is at least as great as the depth of said cut-out; and a control slide, said control slide having a cross-section which permits reception thereof in said longitudinal slot of said change code key after insertion of said change code key in said keyway, said control slide having sufficient length to be at least in part in registration with said cut-out when said slide is received in said slot whereby said control slide may be employed to deliver a longitudinal force against a master pin disposed in said cut-out;

rotation of said plug by means of said change code key with said master pin carried thereby aligning said master pin with said pin tumbler stack receiving chamber and establishing an interface between said master and driver pins, insertion of said slide into said slot in said change code key applying a longitudinal force to said master pin which is translated into a radial force sufficient to overcome the force of said biasing means and cause said master pin to move from said cut-out and into said pin tumbler chamber whereby the interface between said control slide and first master pin will be positioned on the shear line, said master pin being retained in said chamber and inserted into the pin tumbler upon subsequent rotation of said plug back to the initial position and withdrawal of said change code key from said keyway.

* * * * *